US009958231B2

(12) United States Patent
McPherson et al.

(10) Patent No.: US 9,958,231 B2
(45) Date of Patent: May 1, 2018

(54) ARCHERY BOW WITH CIRCULAR STRING TRACK

(71) Applicant: MCP IP, LLC, Sparta, WI (US)

(72) Inventors: Mathew A. McPherson, Norwalk, WI (US); Gary L. Simonds, Gainesville, FL (US)

(73) Assignee: MCP IP, LLC, Sparta, WI (US)

( * ) Notice: Subject to any disclaimer, the term of this patent is extended or adjusted under 35 U.S.C. 154(b) by 0 days. days.

(21) Appl. No.: 15/230,270

(22) Filed: Aug. 5, 2016

(65) Prior Publication Data

US 2016/0341511 A1 Nov. 24, 2016

Related U.S. Application Data

(63) Continuation of application No. 14/725,468, filed on May 29, 2015.

(60) Provisional application No. 62/005,913, filed on May 30, 2014.

(51) Int. Cl.
*F41B 5/10* (2006.01)
*F41B 5/14* (2006.01)

(52) U.S. Cl.
CPC ..... *F41B 5/105* (2013.01); *F41B 5/10* (2013.01); *F41B 5/1403* (2013.01); *F41B 5/1469* (2013.01)

(58) Field of Classification Search
CPC ..... F41B 5/10; F41B 5/105; Y10S 124/90
USPC ..... 124/25.6, 900
See application file for complete search history.

(56) References Cited

U.S. PATENT DOCUMENTS

| | | | | |
|---|---|---|---|---|
| 3,486,495 | A | 12/1969 | Allen | |
| 3,990,425 | A | 11/1976 | Ketchum | |
| 4,078,538 | A * | 3/1978 | Shepley | F41B 5/10 124/25.6 |
| 4,337,749 | A | 7/1982 | Bama | |
| 4,338,910 | A | 7/1982 | Darlington | |
| 4,401,097 | A * | 8/1983 | Simonds | F41B 5/10 124/25.6 |
| 4,440,142 | A | 4/1984 | Simonds | |
| 4,461,267 | A | 7/1984 | Simonds et al. | |
| 4,515,142 | A | 5/1985 | Nurney | |
| 4,519,374 | A * | 5/1985 | Miller | F41B 5/10 124/25.6 |
| 4,660,536 | A | 4/1987 | McPherson | |
| 4,774,927 | A | 10/1988 | Larson | |
| 4,926,833 | A | 5/1990 | Darlington | |
| 4,967,721 | A | 11/1990 | Larson | |
| 5,211,155 | A | 5/1993 | Zamojski | |
| 5,368,006 | A | 11/1994 | McPherson | |
| 5,381,777 | A | 1/1995 | Mitchell et al. | |
| 5,505,185 | A | 4/1996 | Miller | |
| 5,678,529 | A | 10/1997 | Larson | |

(Continued)

*Primary Examiner* — Alexander Niconovich

(57) ABSTRACT

In some embodiments, an archery bow comprises a riser, a first limb supported by the riser and a second limb supported by the riser. A first rotatable member is supported by the first limb and arranged to rotate on a first axis and a second rotatable member is supported by the second limb and arranged to rotate on a second axis. The first rotatable member comprises a first bowstring track comprising a first portion and a second portion, the first portion having a constant radius and a center located on the first axis, the second portion having a varying radius. A bowstring comprises a first end attached to the first rotatable member and a second end attached to the second rotatable member.

20 Claims, 8 Drawing Sheets

(56) References Cited

U.S. PATENT DOCUMENTS 5,687,703 A * 11/1997 Vyprachticky ..... F41B 5/10 124/25.6
5,782,229 A 7/1998 Evans et al.
5,791,323 A 8/1998 Dunlap
5,890,480 A 4/1999 McPherson
5,934,265 A * 8/1999 Darlington ..... F41B 5/10 124/25.6
5,960,778 A 10/1999 Larson
5,975,067 A * 11/1999 Strother ..... F41B 5/10 124/25.6
6,035,840 A 3/2000 McPherson
6,082,347 A 7/2000 Darlington
6,112,732 A 9/2000 Larson
6,247,466 B1 6/2001 McPherson
6,321,736 B1 * 11/2001 McPherson ..... F41B 5/105 124/25
6,443,139 B1 9/2002 McPherson
6,516,790 B1 2/2003 Darlington
6,666,202 B1 12/2003 Darlington
6,688,295 B1 2/2004 Miller
6,776,148 B1 * 8/2004 Islas ..... F41B 5/10 124/25.6
6,792,930 B1 9/2004 Kronengold et al.
6,990,970 B1 * 1/2006 Darlington ..... F41B 5/10 124/25.6
6,994,079 B1 2/2006 Darlington
7,047,958 B1 * 5/2006 Colley ..... F41B 5/10 124/25.6
7,143,757 B1 * 12/2006 Cooper ..... F41B 5/10 124/25.6
7,188,615 B2 3/2007 Chang
7,305,979 B1 * 12/2007 Yehle ..... F41B 5/10 124/25.6
7,441,555 B1 * 10/2008 Larson ..... F41B 5/10 124/25.6
7,946,281 B2 * 5/2011 Miller ..... F41B 5/105 124/25.6
8,020,544 B2 * 9/2011 McPherson ..... F41B 5/105 124/23.1
8,627,810 B2 * 1/2014 McPherson ..... F41B 5/10 124/23.1
8,881,714 B1 * 11/2014 Cooper ..... F41B 5/105 124/23.1
2008/0135032 A1 * 6/2008 Islas ..... F41B 5/10 124/90
2009/0000607 A1 1/2009 Miller
2010/0071677 A1 * 3/2010 Cooper ..... F41B 5/10 124/25.6
2015/0345889 A1 * 12/2015 McPherson ..... F41B 5/105 124/25.6

* cited by examiner

ARCHERY BOW WITH CIRCULAR STRING TRACK

CROSS-REFERENCE TO RELATED APPLICATIONS

This application claims the benefit and is a continuation of U.S. application Ser. No. 14/725,468, filed May 29, 2015, which claims the benefit of U.S. Application No. 62/005,913, filed May 30, 2014, the entire contents of which are hereby incorporated herein by reference.

BACKGROUND OF THE INVENTION

This invention relates generally to archery bows and more specifically to compound archery bows.

Compound bows are known in the art. Compound bows typically have rotating members that define string and cable tracks. As a rotating member rotates about its axis, the string and cable tracks have shapes that amount to cams with respect to the rotation axis. For example, a radius arm between the rotation axis and a string or cable track will change as the track is traversed. The caroming action provided on cables and on the bowstring impacts the way a bow feels when it is shot.

There remains a need for novel bow designs that provide greater efficiencies than prior bows. There remains a need for novel bow designs that mitigate the effects of timing errors between rotating members. There remains a need for novel bow designs that provide a smoother shooting experience than prior bows.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a riser, a first limb supported by the riser and a second limb supported by the riser. A first rotatable member is supported by the first limb and arranged to rotate on a first axis and a second rotatable member is supported by the second limb and arranged to rotate on a second axis. The first rotatable member comprises a first bowstring track comprising a first arc having a constant radius and a center located on the first axis. The second rotatable member comprises a second bowstring track comprising a second arc having a constant radius and a center located on the second axis. A bowstring comprises a first end attached to the first rotatable member and a second end attached to the second rotatable member.

In some embodiments, the first arc comprises a central angle of at least 90 degrees, 180 degrees, 270 degrees or more.

In some embodiments, an outer periphery of a first rotatable member comprises a circle that is centered upon the rotation axis.

In some embodiments, an archery bow comprises a riser, a first limb supported by the riser and a second limb supported by the riser. A first rotatable member is supported by the first limb and arranged to rotate on a first axis and a second rotatable member is supported by the second limb and arranged to rotate on a second axis. The first rotatable member comprises a first cam track and a first bowstring track comprising a first arc having a constant radius and a center located on the first axis. The second rotatable member comprises a second cam track and a second bowstring track comprising a second arc having a constant radius and a center located on the second axis. A first power cable comprises a segment in contact with the first cam track. A second power cable comprises a segment in contact with the second cam track. A bowstring extends between said first rotatable member and said second rotatable member.

In some embodiments, an archery bow comprises a riser, a first limb supported by the riser and a second limb supported by the riser. A first rotatable member is supported by the first limb and arranged to rotate on a first axis and a second rotatable member is supported by the second limb and arranged to rotate on a second axis. A bowstring extends between the rotatable members. The first rotatable member comprises a first bowstring track having a working portion, the working portion arranged to feed out bowstring as the bow is drawn. The working portion comprises a first arcuate portion having a constant radius and a center located on the first axis. The second rotatable member comprises a second bowstring track having a working portion, the working portion arranged to feed out bowstring as the bow is drawn, the working portion comprising a second arcuate portion having a constant radius and a center located on the second axis.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
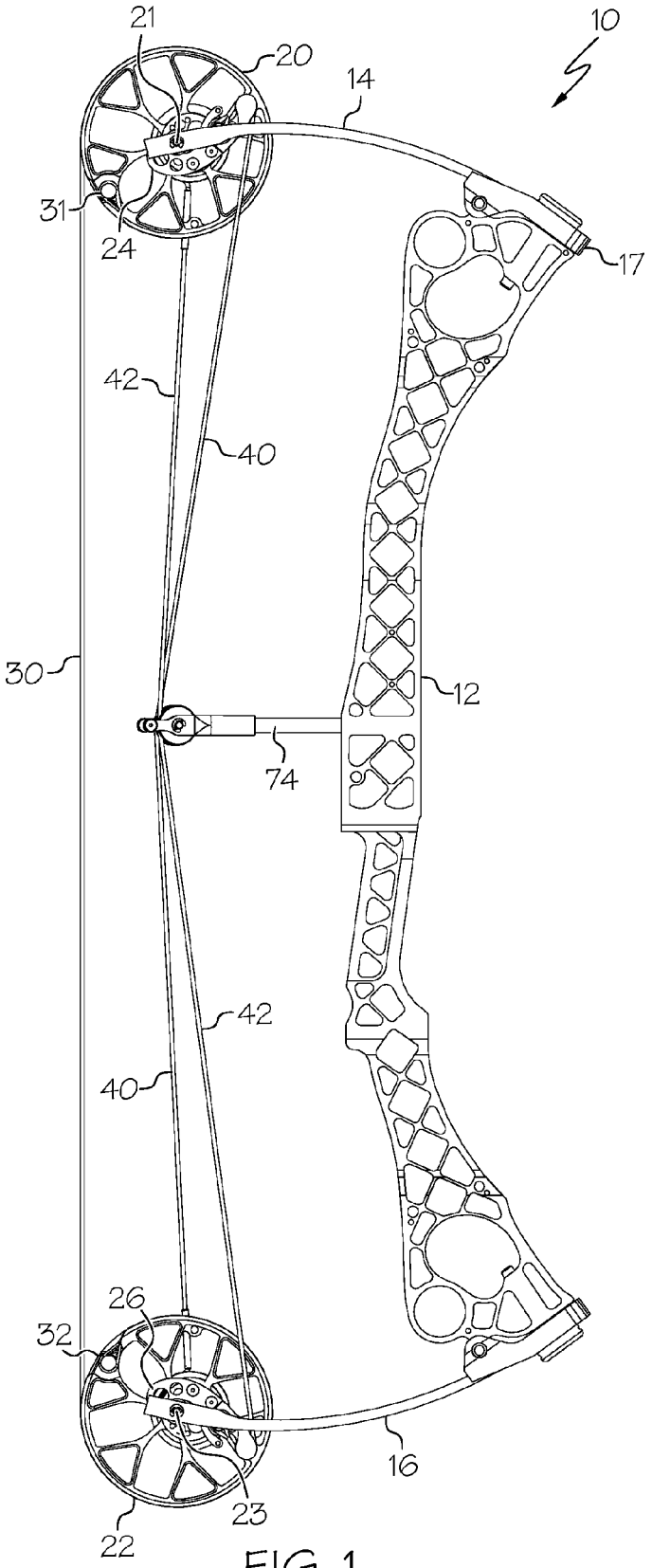
FIG. 1 shows an embodiment of a bow in a brace condition.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10 in a brace condition. In some embodiments, a bow 10 comprises a riser 12 and at least one limb 14 supported by the riser 12. As shown in FIG. 1, the riser 12 supports a first limb 14 at one end and a second limb 16 at the other end. In some embodiments, a limb cup 17 can be used to receive a limb 14. In some embodiments, a limb cup 17 comprises a device as disclosed in U.S. Pat. No. 8,453,635, the entire disclosure of which is hereby incorporated herein by reference.

Desirably, a limb 14 supports at least one rotatable member 20. As shown in FIG. 1, the first limb 14 supports a first rotatable member 20 and the second limb 16 supports a second rotatable member 22. In some embodiments, the first limb 14 supports a first axle 21, and the first axle 21 supports the first rotatable member 20. Similarly, the second limb 16 can support a second axle 23, which in turn supports the second rotatable member 22.

Desirably, a bowstring 30 extends between the first rotatable member 20 and the second rotatable member 22. In some embodiments, a first end 31 of the bowstring 30 is anchored to the first rotatable member 20 and a second end 32 of the bowstring 30 is anchored to the second rotatable member 22. In some embodiments, a segment of the bowstring 30 extends about a periphery of a rotatable member 20 when the bow 10 is in the brace condition.

In some embodiments, the first rotatable member 20 comprises a first cam portion 24 defining a first cam track, and the second rotatable member 22 comprises a second cam portion 26 defining a second cam track. In some embodiments, a first power cable 40 is attached to the first rotatable member 20 and arranged to be taken up by the first cam track when the bow 10 is drawn. In some embodiments, a second power cable 42 is attached to the second rotatable member 22 and arranged to be taken up by the second cam track when the bow 10 is drawn. In some embodiments, the first power cable 40 is anchored to the second axle 23 and the second power cable 42 is anchored to the first axle 21 (not shown). As shown in FIG. 1, the first power cable 40 is anchored to the second rotatable member 22 and the second power cable 42 is anchored to the first rotatable member 20.

Figure 2:
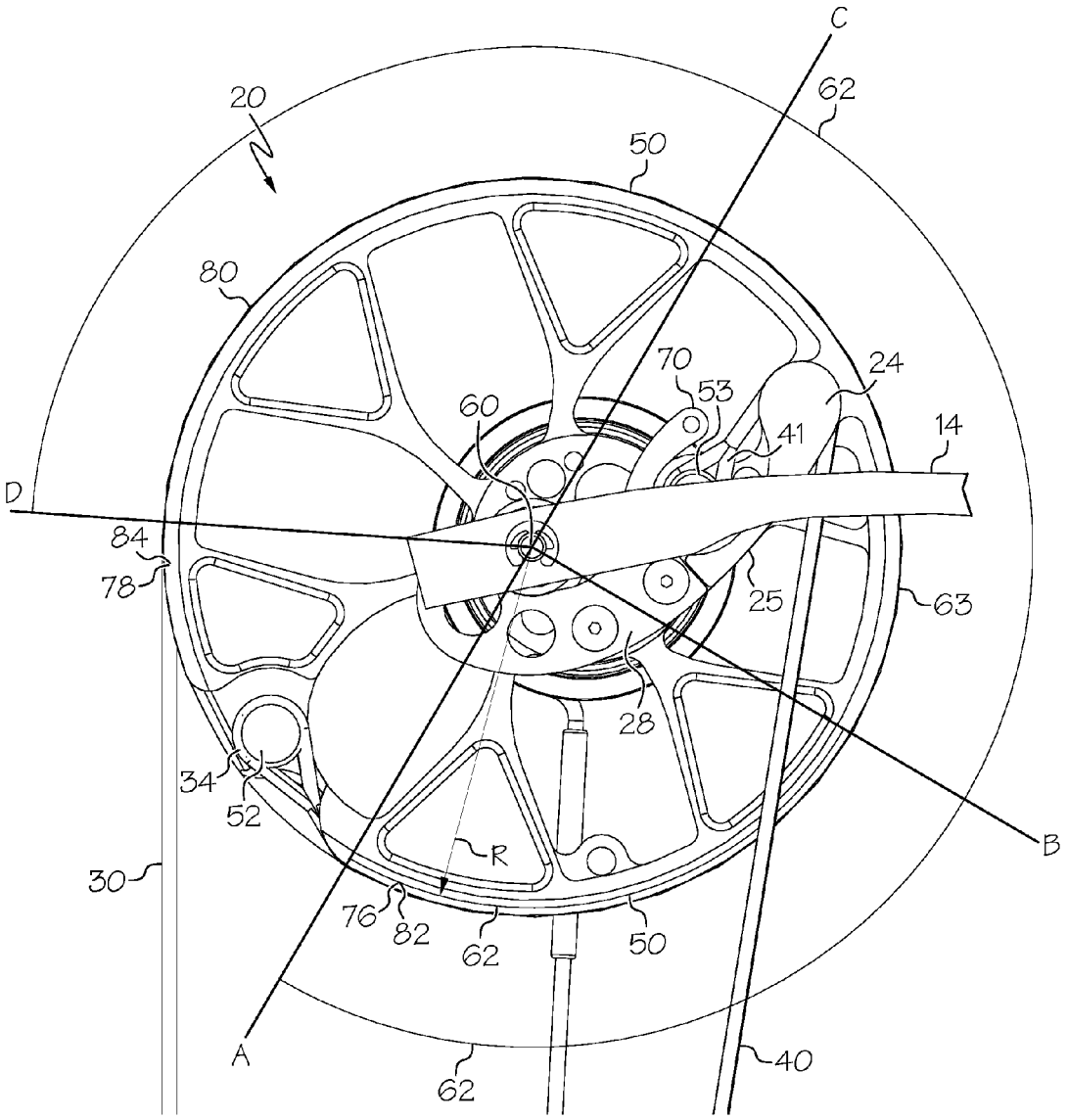
FIG. 2 shows an embodiment of a rotatable member of a bow.

FIG. 2 shows an embodiment of a rotatable member 20 in greater detail. Desirably, the rotatable member 20 defines a bowstring track 50. In some embodiments, the bowstring track 50 extends about a periphery of the rotatable member 20. At least a portion of the bowstring 30 is oriented in the bowstring track 50, and bowstring 30 feeds out from the bowstring track 50 as the bow is drawn. In some embodiments, the rotatable member 20 comprises a first post 52 that serves as a terminal post, and a terminal loop 34 of the bowstring 30 is anchored to the first post 52.

FIG. 2 shows an embodiment of a cam portion 24, which desirably defines a cam track 25. When the bow is drawn, power cable 40 is desirably taken up in the cam track 25. In some embodiments, the rotatable member 20 comprises a second post 53 that serves as a terminal post, and a terminal loop 41 of the power cable 40 is anchored to the second post 53. In some embodiments, the cam portion 24 comprises a module portion 28. Desirably, the module portion 28 can be removed from the rotatable member 20 and alternative modules having different shapes can be substituted. Desirably, the module portion 28 comprises a cam track 25. Different modules can have differently shaped cam track portions and changing modules can change the draw characteristics of the bow, for example adjusting draw weight, draw length, etc.

The first rotatable member 20 is arranged to rotate about a first axis 60. Desirably, at least a portion of the bowstring track 50 comprises an arc 62 having a constant radius R and a center/origin located on the first axis 60. For example, a first radial line A and a second radial line B are shown in FIG. 2. The portion of the bowstring track 50 extending between the first radial line A and the second radial line B comprises an arc 62 having a constant radius R. In various embodiments, any suitable arc length can be used. For example, arc AB extends approximately 90 degrees. In some embodiments, the arc 62 extends for at least 180 degrees—see e.g. third radial line C and arc AC. In some embodiments, the arc 62 extends for at least 270 degrees. In some embodiments, the arc 62 extends for at least 270 degrees—see e.g. fourth radial line D and arc AD. In some embodiments, the arc 62 extends for at least 300 degrees.

In some embodiments, an entire portion of the bowstring track 50 that feeds out bowstring 30 during draw comprises an arc 62 having a constant radius R and a center located on the first axis 60.

In some embodiments, an outer periphery of a rotatable member 20 comprises a circular shape that is centered on the rotation axis (e.g. 60).

As shown in FIG. 1, the second rotatable member 22 can comprise a mirror of the first rotatable member 20, and the second rotatable member 22 can comprise a bowstring track 50 having an arc 62 of constant radius similar to the first rotatable member 20.

Figure 3:
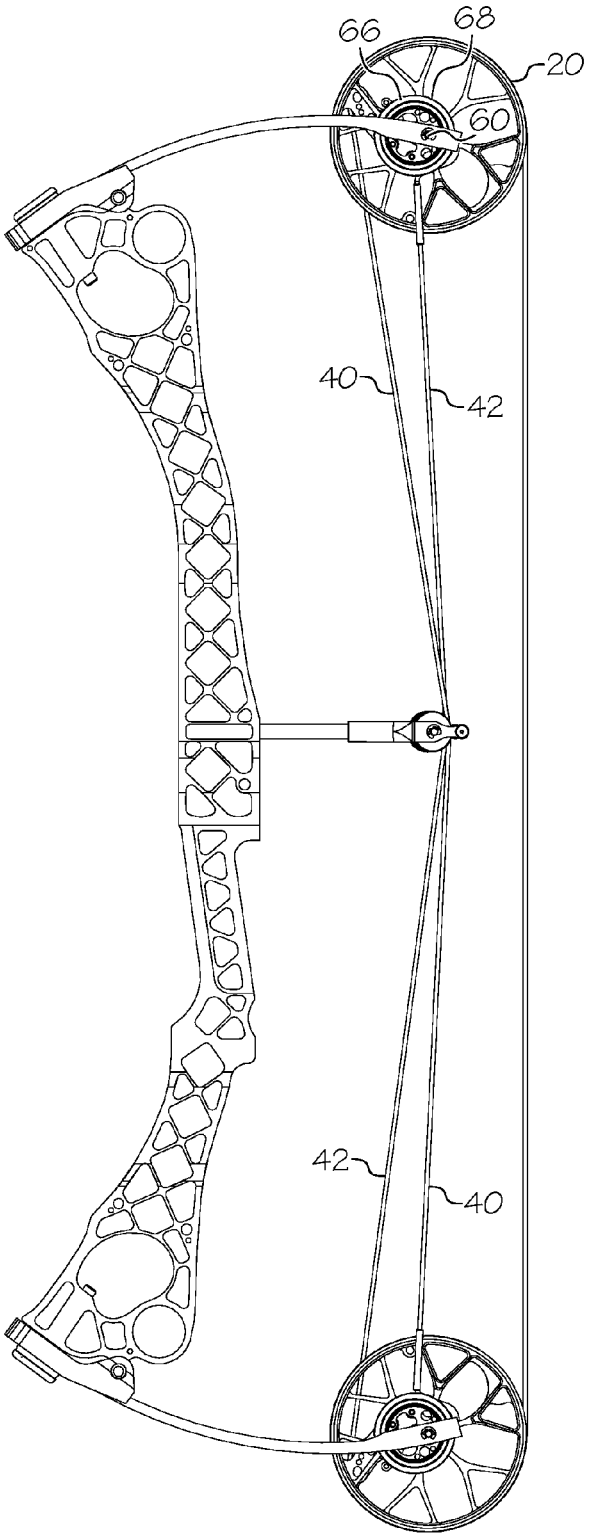
FIG. 3 shows the bow of FIG. 1 from the opposite side.

FIG. 3 shows the bow 10 of FIG. 1 from the opposite side. In some embodiments, a rotatable member 20 comprises a force vectoring anchor 68, and a power cable (e.g. second power cable 42) is anchored to the force vectoring anchor 68. Desirably, a force vectoring anchor 68 defines an anchor axis that is offset from the rotatable member axis (e.g. first axis 60). In some embodiments, a force vectoring anchor 68 comprises an anchor structure as disclosed in U.S. Pat. No. 7,946,281 or U.S. Pat. No. 8,020,544, the entire disclosures of which are hereby incorporated herein by reference.

Figure 8:
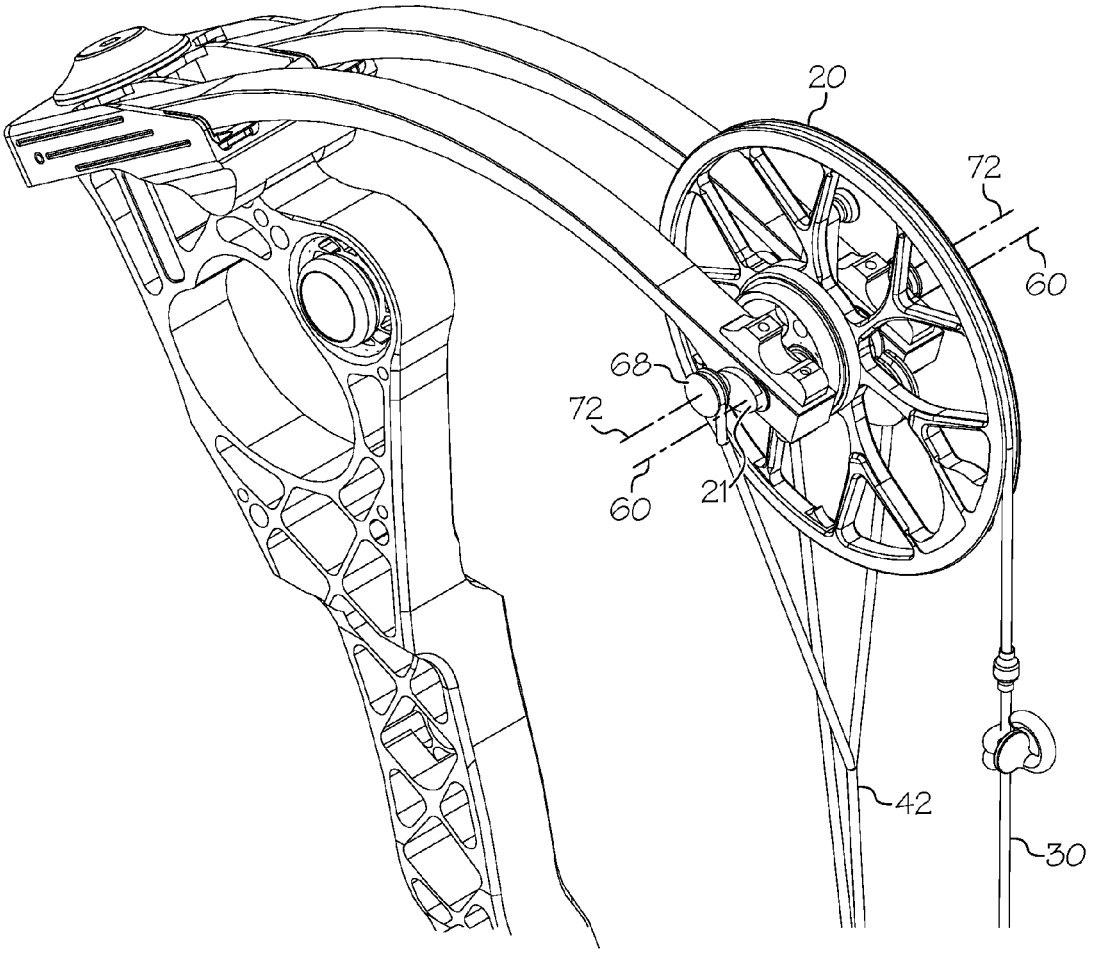
FIG. 8 shows another embodiment of an archery bow.

With reference to FIG. 8, in some embodiments, an axle 21 comprises a force vectoring anchor 68. In some embodiments, the axle 21 supports the rotatable member 20, and the rotatable member 20 rotates about the first axis 60. The axle 21 is desirably attached to the rotatable member 20, and the axle 21 rotates with the rotatable member 20. The axle 21 comprises one or more anchors 68, wherein the anchor axis 72 is offset from the first axis 60. In some embodiments, a force vectoring anchor 68 comprises an anchor structure as disclosed in U.S. Pat. No. 8,181,638, the entire disclosure of which is hereby incorporated herein by reference In some embodiments, a power cable 40, 42 is anchored to an anchoring mechanism (not illustrated) that is arranged to feed out power cable 40, 42 as the bow is drawn, for example as disclosed in U.S. Pat. No. 6,990,970, the entire disclosure of which is hereby incorporated herein by reference.

Figure 4:
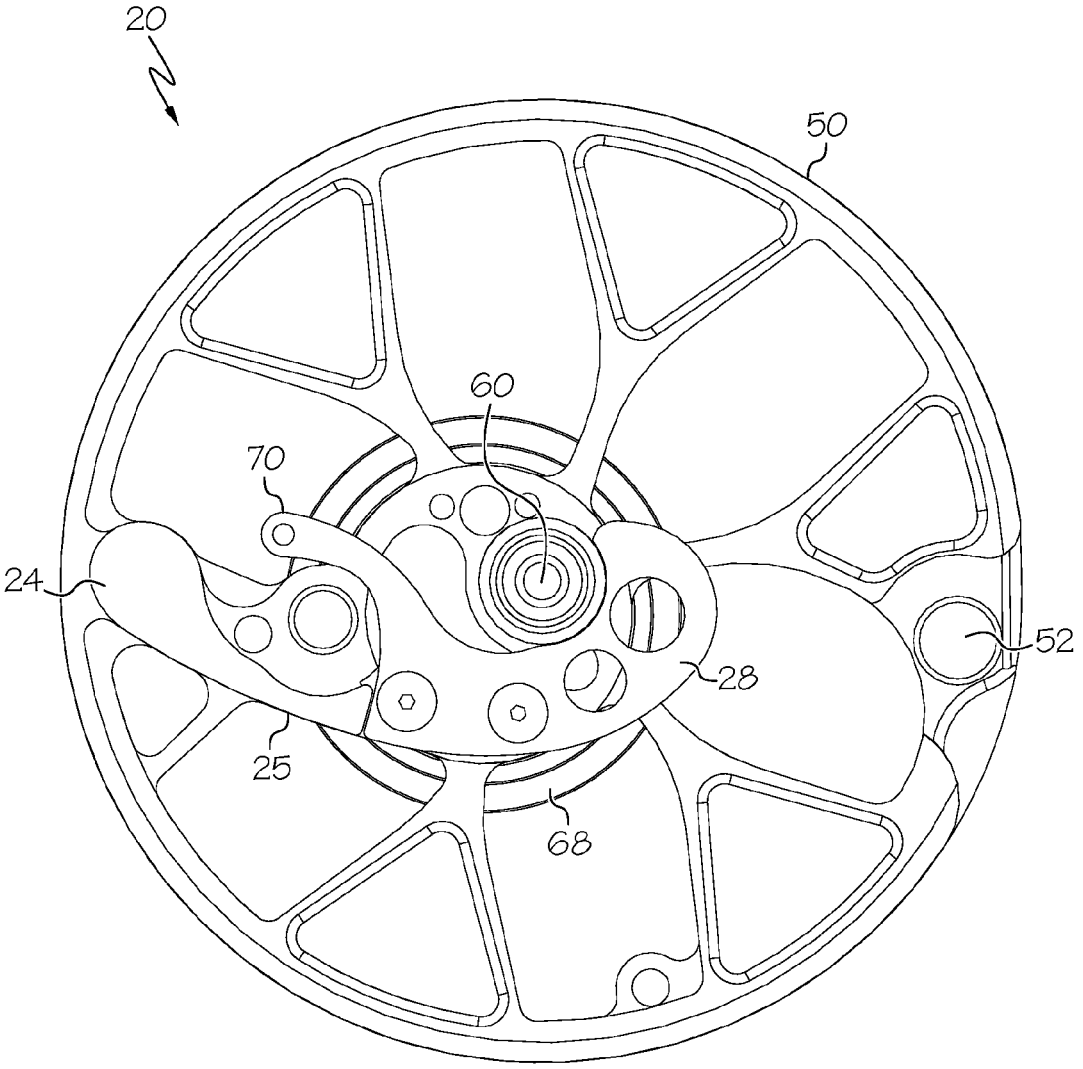
FIG. 4 shows a detail of a rotatable member.

FIG. 4 shows an embodiment of a rotatable member 20 separated from the bow. Like reference characters in the Figures refer to like features.

Figure 5:
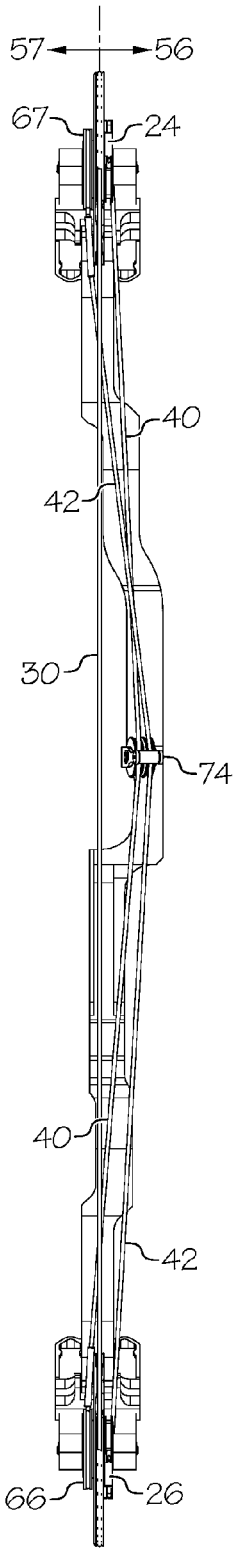
FIG. 5 shows an end view of an embodiment of a bow.

FIG. 5 shows an end view of an embodiment of a bow 10. In some embodiments, the bow 10 comprises a cable guard 74 arranged to bias the power cables 40, 42 laterally away from a plane of bowstring 30 travel. In some embodiments, the first power cable 40 extends from a first cam 24 located to a first side 56 of the bow 10 and extends to an anchor 66 located to a second side 57 of the bow 10. In some embodiments, the second power cable 42 extends from a second cam 26 located to a first side 56 of the bow 10 and extends to an anchor 67 located to a second side 57 of the bow 10. Thus, in some embodiments, cams 24, 26 are located on a common side of the bow and anchors 66, 67 are located on the other side. In some other embodiments, a cam and an anchor can be located on each side of the bow.

Figure 6:
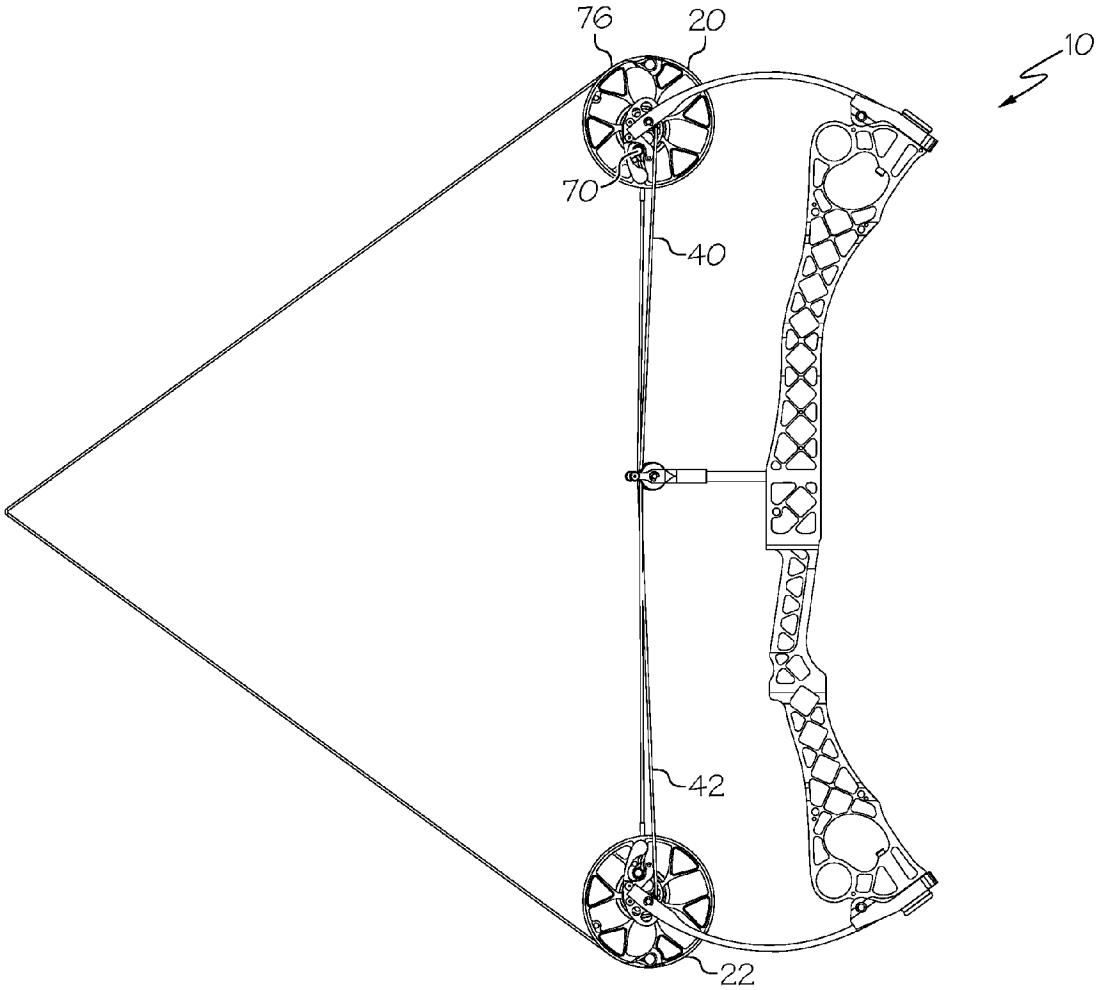
FIG. 6 shows an embodiment of a bow in a drawn condition.

FIG. 6 shows an embodiment of a bow 10 in a drawn configuration.

Figure 7:
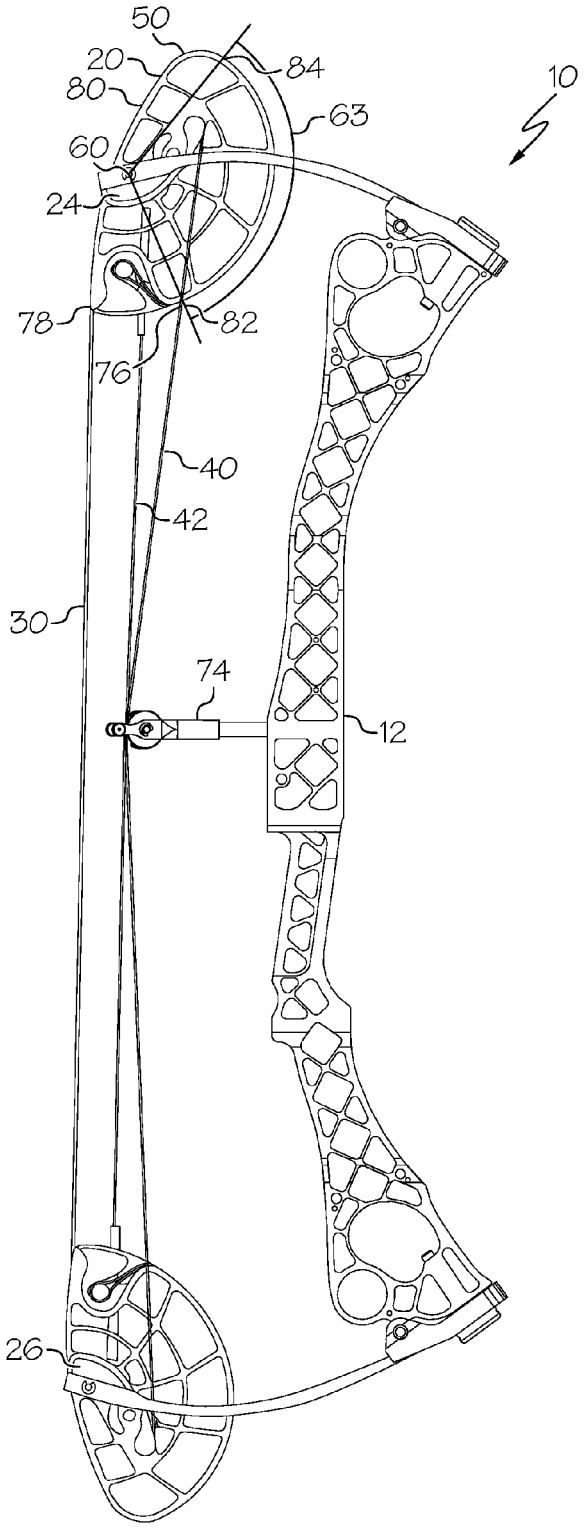
FIG. 7 shows another embodiment of an archery bow.

FIG. 7 shows another embodiment of an archery bow 10. Like reference characters in the Figures refer to like features.

The rotatable members 20, 22 of the bow 10 shown in FIG. 7 have an outer periphery that is not circular; however, desirably a portion of the periphery is circular.

With reference to FIGS. 2 and 7, in some embodiments, a rotatable member 20 comprises a bowstring track 50. In the brace condition of the bow 10, bowstring 30 is oriented in the bowstring track 50, and the bowstring 30 leaves the bowstring track 50 at an end point 78 of a "working range" of the bowstring track 50. As the bow 10 is drawn, bowstring 30 unwraps from the track 50. At full draw (see e.g. FIG. 6), a maximum amount of bowstring 30 has been unwrapped from the track 50, and the bowstring leaves the bowstring track 50 at a start point 76 of the working range 80. Thus, a working range 80 of the bowstring track 50 comprises a length of bowstring track 50 that feeds out bowstring 30 during draw, which extends between a start point 76 and an end point 78. The working range 80 can also be considered the working portion 80 of the bowstring track 50.

Desirably, the working range 80 of the bowstring track 50 comprises an arcuate portion 63 that has a constant radius and a center located on the first axis 60. The arcuate portion 63 extends from a start point 82 to an end point 84. As shown in FIG. 7, the arcuate portion 63 comprises a first portion of the bowstring track 50 and comprises a circular arc having a constant radius from the first axis 60.

The arcuate portion 63 can comprise any suitable portion of the working range 80. In some embodiments, the arcuate portion 63 comprises at least half of the length of the working range 80. In various embodiments, the arcuate portion 63 can range from 50% to 100% of the working range 80. In some embodiments, the arcuate portion 63 comprises at least 60% of the length of the working range 80. In some embodiments, the arcuate portion 63 comprises at least 70% of the length of the working range 80. In some embodiments, the arcuate portion 63 comprises at least 80% of the length of the working range 80. In some embodiments, the arcuate portion 63 comprises at least 90% of the length of the working range 80.

In some embodiments, the start point 82 of the arcuate portion 63 corresponds to the start point 76 of the working range 80. In some embodiments, the start point 82 of the arcuate portion is offset from the start point 76 of the working range 80. In some embodiments, the end point 84 of the arcuate portion corresponds to the end point 78 of the working range 80. In some embodiments, the end point 84 of the arcuate portion is offset from the end point 78 of the working range 80. As shown in FIG. 7, the portion of the bowstring track 50 between the end point 84 of the arcuate portion 63 and the end point 78 of the working range 80 comprises a second portion of bowstring track 50 comprising a non-circular arc having a varying radius from the first axis 60. As shown in FIG. 7, the constant radius of the first portion/non-circular portion of the bowstring track 50. As shown in FIG. 7, an outer periphery of the first rotatable member 20 is continuously concave with respect to the first axis 60.

As bowstring 30 feeds from the arcuate portion 63 during draw, the moment applied to the rotatable member 20 by the bowstring 30 will have a constant moment arm. This contributes to a smoother draw. Further, in the event that rotation of the two rotatable members 20, 22 are not perfectly timed, the effects of such timing errors are minimized when compared to traditionally programmed bowstring tracks because the tension in the bowstring and the moment arms remain constant.

In some embodiments, a cable guard 74 is arranged to contact one or more power cables 40, 42 at a location that is equally spaced from the axis of rotation (e.g. 60) of each rotatable member 20, 22.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

riser;

a first limb supported by said riser;

a second limb supported by said riser;

a first rotatable member supported by said first limb and arranged to rotate on a first axis, said first rotatable member comprising a bowstring track;

a second rotatable member supported by said second limb and arranged to rotate on a second axis; and a bowstring comprising a first end attached to said first rotatable member, the bowstring extending to said second rotatable member;

wherein said bowstring track comprises a first portion and a second portion, said first portion comprising a circular arc having a constant radius from the first axis, said circular arc extending at least 90 degrees about said first axis, said second portion comprising a non-circular arc having a varying radius from said first axis, said non-circular arc extending at least 90 degrees about said first axis, said constant radius being greater than any portion of said varying radius.

2. The archery bow of claim 1, said bowstring track comprising a working portion that feeds out said bowstring as the bow is drawn, the working portion comprising said first portion and said second portion.

3. The archery bow of claim 2, said working portion consisting of said first portion and said second portion.

4. The archery bow of claim 2, said circular arc comprising at least half of a length of said working portion.

5. The archery bow of claim 1, wherein an outer periphery of said first rotatable member comprises a circular portion and a non-circular portion.

6. The archery bow of claim 1, said second rotatable member comprising a second bowstring track, said second bowstring track comprising a circular arc having a constant radius from the second axis.

7. The archery bow of claim 6, wherein a shape of said first rotatable member comprises a mirror image of a shape of said second rotatable member.

8. The archery bow of claim 1, wherein said circular arc extends at least 180 degrees.

9. The archery bow of claim 1, said bowstring track being a first bowstring track, said second rotatable member comprising a second bowstring track, a shape of the second bowstring track being a mirror image of a shape of the first bowstring track.

10. An archery bow comprising:

a riser;

a first limb supported by said riser;

a second limb supported by said riser;

a first rotatable member supported by said first limb and arranged to rotate on a first axis, said first rotatable member comprising a bowstring track and a first cam track;

a second rotatable member supported by said second limb and arranged to rotate on a second axis, said second rotatable member comprising a bowstring track and a second cam track;

a first power cable comprising a segment in contact with said first cam track; and a second power cable comprising a segment in contact with said second cam track; and a bowstring extending between said first rotatable member and said second rotatable member;

wherein an outer periphery of the first rotatable member comprises a first portion and a second portion, said first portion comprising a circular arc having a constant radius from the first axis, said circular arc extending at least 90 degrees about the first axis, said second portion comprising an arc having a varying radius from the first axis, said outer periphery being continuously concave with respect to the first axis.

11. The archery bow of claim 10, wherein said outer periphery consists of said first portion and said second portion.

12. The archery bow of claim 10, wherein a radial distance from said first axis to said second portion is less than said constant radius.

13. The archery bow of claim 10, wherein said bowstring track comprises said first portion and said second portion.

14. The archery bow of claim 10, said bowstring track comprising a working portion that feeds out said bowstring as the bow is drawn, the working portion comprising said first portion and said second portion.

15. The archery bow of claim 14, said circular arc comprising at least half of a length of said working portion.

16. The archery bow of claim 10, wherein said circular arc extends at least 180 degrees.

17. The archery bow of claim 10, said first power cable comprising a first end and a second end, the first end attached to the first rotatable member, the second end attached to the second rotatable member.

18. An archery bow comprising:

a riser;

a first limb supported by said riser;

a second limb supported by said riser;

a bowstring;

a first rotatable member supported by said first limb and arranged to rotate on a first axis, said first rotatable member comprising a bowstring track having a working portion, said working portion arranged to feed out said bowstring as the bow is drawn; and a second rotatable member supported by said second limb and arranged to rotate on a second axis, said second rotatable member comprising a second bowstring track;

said working portion comprising a first portion and a second portion, said first portion comprising a circular arc having a constant radius from the first axis, said circular arc comprising approximately 50% of said working portion, said second portion comprising an arc having a varying radius from the first axis, said second portion occupying the remainder of said working portion, said constant radius being greater than any portion of said varying radius.

19. The archery bow of claim 18, wherein an entire length of said second portion comprises curvature.

20. The archery bow of claim 18, a shape of said second bowstring track being a mirror image of a shape of said bowstring track.

* * * * *